US011274355B2

(12) United States Patent
Toyoda et al.

(10) Patent No.: US 11,274,355 B2
(45) Date of Patent: Mar. 15, 2022

(54) HOT ROLLED STEEL SHEET AND METHOD FOR PRODUCING SAME

(71) Applicant: NIPPON STEEL CORPORATION, Tokyo (JP)

(72) Inventors: Takeshi Toyoda, Tokyo (JP); Riki Okamoto, Tokyo (JP); Natsuko Sugiura, Tokyo (JP); Tetsuya Hirashima, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 316 days.

(21) Appl. No.: 16/481,765

(22) PCT Filed: Feb. 16, 2018

(86) PCT No.: PCT/JP2018/005570
§ 371 (c)(1),
(2) Date: Jul. 29, 2019

(87) PCT Pub. No.: WO2018/151273
PCT Pub. Date: Aug. 23, 2018

(65) Prior Publication Data

US 2019/0390294 A1 Dec. 26, 2019

(30) Foreign Application Priority Data

Feb. 16, 2017 (JP) ..... JP2017-027043

(51) Int. Cl.

| | |
|---|---|
| ***C21D 9/46*** | (2006.01) |
| ***B21B 3/02*** | (2006.01) |
| ***B21B 45/00*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |

(52) U.S. Cl.
CPC ..... *C21D 9/46* (2013.01); *B21B 3/02* (2013.01); *B21B 45/004* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/26* (2013.01); *C22C 38/28* (2013.01)

(58) Field of Classification Search
CPC ..... C21D 9/46; C21D 6/002; C21D 6/005; C21D 6/008; C21D 8/0205; C21D 8/0226; C21D 8/0263; B21B 3/02; B21B 45/004; C22C 38/001; C22C 38/002; C22C 38/02; C22C 38/04; C22C 38/06; C22C 38/22; C22C 38/26; C22C 38/28
See application file for complete search history.

(56) References Cited

U.S. PATENT DOCUMENTS

| | | | | |
|---|---|---|---|---|
| 2006/0137769 | A1 | 6/2006 | Yuse et al. | |
| 2015/0030880 | A1 | 1/2015 | Kosaka et al. | |
| 2016/0273066 | A1 | 9/2016 | Sakakibara et al. | |
| 2018/0237874 | A1* | 8/2018 | Yamazaki | C22C 38/60 |
| 2019/0169729 | A1* | 6/2019 | Yokoyama | C22C 38/28 |

FOREIGN PATENT DOCUMENTS

| | | | |
|---|---|---|---|
| EP | 3 650 569 | A1 | 5/2020 |
| JP | 2006-207021 | A | 8/2006 |
| JP | 2006207021 | A * | 8/2006 |
| JP | 3858146 | B2 | 12/2006 |

(Continued)

OTHER PUBLICATIONS

International Preliminary Report on Patentability and Written Opinion of the International Searching Authority (forms PCT/IB/373, PCT/ISA/237 and PCT/IB/326), dated Aug. 29, 2019, for corresponding International Application No. PCT/JP2018/005570, with a Written Opinion translation.

(Continued)

*Primary Examiner* — Christopher S Kessler
*Assistant Examiner* — Andrew M Cheung
(74) *Attorney, Agent, or Firm* — Birch, Stewart, Kolasch & Birch, LLP

(57) ABSTRACT

A hot rolled steel sheet is provided, which is excellent in collision characteristics, excellent in anisotropy of toughness, and high in strength. The hot rolled steel sheet is characterized by containing, by mass %, C: 0.10% to 0.50%, Si: 0.10% to 3.00%, Mn: 0.5% to 3.0%, P: 0.100% or less, S: 0.010% or less, Al: 1.00% or less, N: 0.010% or less and a balance of Fe and impurities, wherein a metal structure at position of ¼ thickness from surface in L-cross-section of the steel sheet comprises prior austenite grains of average value of aspect ratios of 2.0 or less, average grain size of 0.1 μm to 3.0 μm, and coefficient of variation of a standard deviation of grain size distribution/average grain size of 0.40 or more, and a texture with X-ray diffraction intensity ratio of {001}<110>orientation for random samples of 2.0 or more, and the steel sheet has tensile strength of 1180 MPa or more.

2 Claims, No Drawings

(56) References Cited

FOREIGN PATENT DOCUMENTS

| | | | | |
|---|---|---|---|---|
| JP | 2011-52321 | A | 3/2011 | |
| JP | 5068688 | B2 | 11/2012 | |
| JP | 5556948 | B1 | 7/2014 | |
| JP | 2016-211073 | A | 12/2016 | |
| WO | WO 2013/004910 | A1 | 1/2013 | |
| WO | WO 2013/111556 | A1 | 8/2013 | |
| WO | WO 2014/185405 | A1 | 11/2014 | |
| WO | WO 2017/017933 | A1 | 2/2017 | |
| WO | WO-2018011978 | A1 * | 1/2018 | ..... B32B 15/04 |

OTHER PUBLICATIONS

International Search Report (form PCT/ISA/210), dated May 15, 2018, for corresponding International Application No. PCT/JP2018/005570, with an English translation.

* cited by examiner

HOT ROLLED STEEL SHEET AND METHOD FOR PRODUCING SAME

FIELD

The present invention relates to a steel sheet which is hot rolled (below, referred to as a "hot rolled steel sheet") and a method for producing the same, more particularly relates to a hot rolled steel sheet excellent in anisotropy of toughness and having tensile strength of 1180 MPa or more and to a method for producing the same.

BACKGROUND

In recent years, for improvement of the fuel efficiency and collision safety of automobiles, there have been numerous attempts to lighten car bodies through use of high strength steel sheet. However, if making steel sheet high in strength, in general the toughness deteriorates. For this reason, in development of high strength steel sheet, improvement of the strength without causing deterioration of the toughness is an important topic. In particular, in high strength steel sheet used for automobile members, it is important to secure collision characteristics. Here, to improve the toughness, it is generally known to improve the toughness by rolling the steel at a low temperature and imparting a high cumulative strain by the nonrecrystallized austenite.

As opposed to this, PTL 1 proposes cold rolled steel sheet obtained by making the reduction rate and the average strain rate at 860 to 960° C. where austenite becomes the nonrecrystallized region suitable ranges to make the volume rate of the structures transformed from the nonrecrystallized austenite increase and using the fine grain structures created by hot rolling to improve the toughness of the cold rolled steel sheet. However, there is the problem that if making the rolling reduction in nonrecrystallized austenite increase, the aspect ratio of the prior austenite grains becomes higher and the anisotropy of toughness becomes stronger.

PTL 2 proposes a hot rolled steel sheet obtained by making the finishing temperature higher and raising the rolling reduction at 1000° C. or less to promote the recrystallization of austenite and shorten the time up to cooling after rolling to thereby reduce the anisotropy. However, by raising the rolling reduction at 1000° C. or less, recrystallization is promoted, but since the finishing rolling is performed at a high temperature, recrystallization is promoted between the stands and it is not possible to maintain a high strain at the final stand. For this reason, there is the problem that only coarse recrystallized prior austenite grains are formed and the toughness deteriorates.

To deal with this, PTL 3 proposes a hot rolled steel sheet obtained by making the cumulative rolling reduction at over 840° C. 30% or more and making the rolling reduction at 840° C. or less 30% to 75% to keep down the aspect ratio of the prior austenite grains and make the crystal grain size 10 μm to 60 μm. However, when rolling steel at 840° C. or less, no recrystallization occurs and the grains grow by the introduced strain, so there is the problem of the crystal grains becoming coarser.

CITATION LIST

Patent Literature

[PTL 1] Japanese Patent No. 3858146
[PTL 2] Japanese Patent No. 5068688
[PTL 3] Japanese Patent No. 5556948

SUMMARY

Technical Problem

In recent years, there have been rising demands for further lightening the weight of automobiles. High strength steel sheet high in absorption energy at the time of high speed deformation, excellent in collision characteristics as an auto part, and excellent in anisotropy of toughness is being sought.

The present invention has been made considering the above problem. The present invention has as its object the provision of high strength steel sheet excellent in these characteristics.

Solution to Problem

In the past, various attempts have been made to improve the toughness of steel by raising the cumulative rolling reduction in the nonrecrystallized austenite and making the structures finer. The inventors took note of the fact that if the rolling reduction of nonrecrystallized austenite is raised, the anisotropy of the structures is strong and the toughness in the case where cracks propagate parallel to the rolling direction is inferior, and engaged in intensive studies. As a result, they again took note of the previously avoided recrystallization phenomenon of recrystallization after applying a high strain and discovered that by utilizing this, it is possible to improve the anisotropy and raise the toughness in a hot rolled steel sheet. Specifically, they confirmed that by setting suitable rolling reduction at the last four stands in the plurality of stands in a successive plurality of four or more hot rolling stands and controlling the temperature and strain rate at the final stand of the four stands to enable recrystallization, the austenite finely recrystallizes and anisotropy of the structures is eliminated.

The present invention has been made based on the above finding. The gist of the present invention is as follows:

(1) A hot rolled steel sheet characterized by containing, by mass %,
C: 0.10% or more and 0.50% or less,
Si: 0.10% or more and 3.00% or less,
Mn: 0.5% or more and 3.0% or less,
P: 0.100% or less,
S: 0.010% or less,
Al: 1.00% or less,
N: 0.010% or less and
a balance of Fe and impurities,
wherein a metal structure at a position of ¼ thickness from a surface in an L-cross-section of the steel sheet comprises prior austenite grains of an average value of aspect ratios of 2.0 or less, an average grain size of 0.1 μm or more and 3.0 μm or less, and a coefficient of variation of a standard deviation of grain size distribution/average grain size of 0.40 or more, and a texture with an X-ray diffraction intensity ratio of {001}<110> orientation with respect to random samples of 2.0 or more, and
the hot rolled steel sheet has tensile strength of 1180 MPa or more.

(2) The hot rolled steel sheet according to the above (1) further containing, by mass %, one or more elements selected from a group consisting of
Ti: 0.02% or more and 0.20% or less,
Nb: 0.00% or more and 0.10% or less,
Ca: 0.0000% or more and 0.0060% or less,
Mo: 0.00% or more and 0.50% or less, and
Cr: 0.0% or more and 1.0% or less.

(3) A method for producing the hot rolled steel sheet according to the above (1) or (2), characterized in that the method comprises steps (a) to (e) shown below:

(a) a heating step of heating a slab having a chemical composition according to the above (1) or (2) to 1100° C. or more and less than 1350° C.;

(b) a rolling step of rolling the slab after the heating using a rolling machine having a plurality of four or more stands, wherein total length of last four stands among the plurality of stands is 18 meters or less and reduction in sheet thickness before and after the last four stands satisfies a following formula 1:

$$1.2 \leq \ln(t_0/t) \leq 3.0 \quad \text{(formula 1)}$$

wherein $t_0$ is the sheet thickness right before entering the last four stands, and t is the sheet thickness right after leaving the last four stands;

(c) a step wherein a strain rate at a final stand of the last four stands and a rolling temperature at the final stand satisfy following formula 2 and formula 3:

$$11.0 \leq \log(v \times \exp(33000/(273+T)) \leq 15.0 \quad \text{(formula 2)}$$

$$T \geq Ar_3 \text{ point} \quad \text{(formula 3)}$$

wherein v is a strain rate (/s) at the final stand while T is a rolling exit side temperature (° C.) at the final stand;

(d) a cooling step of starting cooling the rolled steel sheet within 1.0 second after an end of the rolling and cooling the rolled steel sheet over a temperature range of a final rolling temperature to 750° C. by a 100° C./s or more average cooling rate; and (e) a coiling step of coiling the cooled steel sheet after the cooling step.

Advantageous Effects of Invention

According to the above aspects of the present invention, it is possible to provide a hot rolled steel sheet high in absorption energy at the time of high speed deformation, excellent in collision characteristics as an auto part, excellent in anisotropy of toughness, and high in strength. According to this hot rolled steel sheet, it is possible to lighten the weight of bodies of automobiles etc., integrally form parts, and shorten the working process, and possible to improve the fuel efficiency and reduce the manufacturing costs, so the present invention is high in industrial value.

DESCRIPTION OF EMBODIMENTS

A hot rolled steel sheet according to one embodiment of the present invention will be explained. The hot rolled steel sheet according to the present embodiment controls the behavior of growth of recrystallized grains during the hot finish rolling. By adjusting the amount of strain by the succeeding stands and making the strain reach the critical strain required for recrystallization at the final stand, it is possible to form fine recrystallized grains and create structures with fine structures of crystal grains made polygonal in shape free of anisotropy. Even after recrystallization, the time until the cooling start time is made extremely short to suppress growth of recrystallized grains. By creating fine, polygonal austenite grains in the hot rolling step, it is possible to obtain a hot rolled steel sheet excellent in toughness. Further, the cold rolled steel sheet or heat treatment use steel sheet obtained by further working hot rolled steel sheet becomes steel sheet excellent in toughness. Specifically, the hot rolled steel sheet according to the present embodiment has a predetermined chemical composition and tensile strength of 1180 MPa or more, and has a metal structure comprising prior austenite grains with an average value of the aspect ratios of 2.0 or less, an average grain size of 0.1 μm or more and 3.0 μm or less, and a coefficient of variation of the standard deviation of grain size distribution/average grain size of 0.40 or more, and a texture with an X-ray diffraction intensity ratio of the {001}<110> orientation for a random sample of 2.0 or more.

Below, the individual constituent requirements of the present invention will be explained in detail. First, the reasons for limitation of the chemical composition (chemical ingredients) of the hot rolled steel sheet according to the present embodiment will be explained. The "%" in the chemical contents mean "mass %".

C: 0.10% or More and 0.60% or Less

C is an element important for improving the strength of the steel sheet. To obtain the target strength, the content of C has to be 0.10% or more. The content of C is preferably 0.25% or more. However, if the content of C exceeds 0.60%, the toughness of the steel sheet deteriorates. For this reason, the content of C is 0.60% or less. The content of C is preferably 0.50% or less.

Si: 0.10% or More and 3.00% or Less

Si is an element having the effect of improving the strength of the steel sheet. To obtain this effect, the content of Si is 0.10% or more. The content of Si is preferably 0.50% or more. On the other hand, if the content of Si exceeds 3.00%, the toughness of the steel sheet deteriorates. For this reason, the content of Si is 3.00% or less. The content of Si is preferably 2.50% or less.

Mn: 0.5% or More and 3.0% or Less

Mn is an element effective for improving the strength of the steel sheet through improvement of the hardenability and solution strengthening. To obtain this effect, the content of Mn is 0.5% or more. The content of Mn is preferably 1.0% or more. On the other hand, if the content of Mn exceeds 3.0%, MnS harmful to the isotropy of toughness is generated. For this reason, the content of Mn is 3.0% or less. The content of Mn is preferably 2.0% or less.

P: 0.100% or Less

P is an impurity. The lower the content of P, the more desirable. That is, if the content of P exceeds 0.100%, the workability and the weldability remarkably drops and the fatigue characteristics also fall. For this reason, the content of P is limited to 0.100% or less. The content of P is preferably 0.050% or less.

S: 0.010% or Less

S is an impurity. The lower the content of S, the more desirable. That is, if the content of S exceeds 0.010%, MnS and other inclusions harmful to the isotropy of toughness are remarkably generated. For this reason, the content of S is limited to 0.010% or less. If in particular a severe low temperature toughness is demanded, the content of S is preferably 0.006% or less.

Al: 1.00% or Less

Al is an element required for deoxidation in the steelmaking process. However, if the content of Al exceeds 1.00%, alumina is formed precipitating in clusters and the toughness deteriorates. For this reason, the content of Al is 1.00% or less. Preferably it is 0.50% or less.

N: 0.010% or Less

N is an impurity. If the content of N exceeds 0.010%, coarse nitrides are formed at a high temperature and the toughness of the steel sheet deteriorates. Therefore, the content of N is 0.010% or less. The content of N is preferably 0.006% or less.

The hot rolled steel sheet according to the present embodiment basically contains the above chemical ingredients and has a balance of Fe and impurities. While not essential elements for satisfying the demanded characteristics, to reduce the variation in manufacture and improve the strength, it is also possible to further include one or more elements selected from a group consisting of Ti, Nb, Ca, Mo, and Cr in the following ranges. However, none of Nb, Ca, Mo, and Cr are essential for satisfying the demanded characteristics, so the lower limit of the content is 0%. Here, "impurities" means constituents entering from ore, scrap, and other raw materials and due to other factors when industrially producing a steel material. If the contents of Nb, Ca, Mo, and Cr are less than the lower limits of contents shown below, these elements can be deemed impurities. There is no substantial influence on the effects of the hot rolled steel sheet according to the present embodiment.

Ti: 0.02% or More and 0.20% or Less

Ti is an element effective for suppressing the recrystallization and grain growth of austenite between stands (between passes). By suppressing the recrystallization of austenite between stands, it is possible to accumulate strain more. By adding Ti in 0.02% or more, it is possible to obtain the effect of suppression of the recrystallization and grain growth of austenite. The content of Ti is preferably 0.08% or more. On the other hand, if the content of Ti exceeds 0.20%, inclusions due to TiN are formed and the toughness of the steel sheet deteriorates. For this reason, the content of Ti is 0.20% or less. The content of Ti is preferably 0.16% or less.

Nb: 0.00% or More and 0.10% or Less

Nb is an element effective for suppressing the recrystallization and grain growth of austenite between stands. By suppressing the recrystallization of austenite between stands, it is possible to accumulate strain more. To substantially obtain the effect of suppression of recrystallization and grain growth of austenite between stands, the content of Nb is preferably 0.01% or more. On the other hand, if the content of Nb exceeds 0.10%, that effect becomes saturated. For this reason, even if including Nb, the upper limit of content of Nb is 0.10%. The more preferable upper limit of content of Nb is 0.06% or less.

Ca: 0.0000% or More and 0.0060% or Less

Ca is an element having the effect of causing dispersion of a large number of fine oxides at the time of deoxidation of molten steel and refining the structure of the steel sheet. Further, Ca is an element fixing the S in the steel as spherical CaS and suppressing the generation of MnS or other flattened inclusions to improve the anisotropy of toughness. To substantively obtain these effects, the content of Ca is preferably 0.0005% or more. On the other hand, even if the content of Ca exceeds 0.0060%, the effect becomes saturated. For this reason, even if including Ca, the upper limit of content of Ca is 0.0060%. The preferable upper limit of the Ca content is 0.0040%.

Mo: 0.00% or More and 0.50% or Less

Mo is an element effective for precipitation strengthening of ferrite. To substantively obtain this effect, the content of Mo is preferably 0.02% or more. The content of Mo is more preferably 0.10% or more. On the other hand, if the content of Mo becomes excessive, the crack sensitivity of the slab rises and handling of the slab becomes difficult. For this reason, even if including Mo, the upper limit of content of Mo is 0.50%. The more preferable upper limit of the content of Mo is 0.30%.

Cr: 0.0% or More and 1.0% or Less

Cr is an element effective for improving the strength of the steel sheet. To substantively obtain this effect, the content of Cr is preferably 0.02% or more. The content of Cr is more preferably 0.1% or more. On the other hand, if the content of Cr becomes excessive, the ductility falls. For this reason, even if included, the upper limit of content of Cr is 1.0%. The more preferable upper limit of the content of Cr is 0.8%.

Next, the structures of the hot rolled steel sheet according to the present embodiment will be explained.

The hot rolled steel sheet according to the present embodiment has structures comprised of finely recrystallized prior austenite grains. With tensile strength of the 1180 MPa class or more, the average grain size of the prior austenite grains greatly depends on the toughness, so the transformed structures, that is, the steel sheet structures, are not an issue. To reduce the absolute value and anisotropy of the toughness, a single phase is preferable. In high strength steel, a single phase of martensite is often used.

To improve the toughness, it has been known in advance that making the prior austenite structures finer is effective. As the means for this, the general practice has been to raise the cumulative rolling reduction of the nonrecrystallized austenite and flatten the structures. However, in the case accompanied with complex deformation such as the collision characteristic of steel sheet for automobile use, with just high toughness in one direction, good characteristics cannot be obtained. It is necessary to improve the anisotropy with respect to the rolling direction. Therefore, the inventors engaged in intensive research, discovered that the crack propagation characteristic of toughness is greatly dependent on the shapes of the prior austenite structures, and discovered that to reduce that anisotropy, it is effective to cause recrystallization at the austenite and make it polygonal. Furthermore, they discovered the method of making the strain rate and rolling temperature at the final stand of the hot rolling suitable ranges since if promoting recrystallization by making the hot rolling temperature higher, the crystal grains end up becoming coarser. Due to this method, it is possible to cause recrystallization only at the final stand and obtain fine austenite recrystallized grain structures and possible to obtain steel sheet having tensile strength of 1180 MPa or more and provided with excellent toughness.

Metal Structure Containing Prior Austenite Grains of an Average Value of Aspect Ratios of the Grains of 2.0 or Less, an Average Grain Size of 0.1 μm or More and 3.0 μm or Less, and a Coefficient of Variation of a Standard Deviation of Grain Size Distribution/Average Grain Size of 0.40 or More, and a Texture with an X-Ray Diffraction Intensity Ratio of {001}<110>Orientation with Respect to Random Samples of 2.0 or More The metal structure at the position of ¼ the thickness from the surface in the L-cross-section of the steel sheet of the present embodiment comprises prior austenite grains with an average value of the aspect ratios of 2.0 or less, an average grain size of 0.1 μm or more and 3.0 μm or less, and a coefficient of variation of the standard deviation of the grain size distribution/average grain size of 0.40 or more, and a texture with an X-ray diffraction intensity ratio of {001}<110> for random samples of 2.0 or more.

The aspect ratio of prior austenite grains is the ratio of the average crystal grain size in the rolling direction divided by the average crystal grain size in the thickness direction. The "L-cross-section" means the surface cut so as to pass through the center axis of the steel sheet parallel to the sheet thickness direction and the rolling direction.

With an average value of aspect ratios of prior austenite grains of over 2.0, anisotropy of toughness occurs and the crack propagation characteristic parallel to the rolling direction becomes inferior. The aspect ratios of the prior austenite grains tend to become higher when the accumulated strain is insufficient, the rolling temperature is low, or both and thereby the recrystallization rate of austenite cannot be sufficiently obtained. To make the anisotropy smaller or completely eliminate it, the aspect ratios of the prior austenite grains are preferably 1.7 or less, more preferably 1.5 or less, still more preferably 1.3 or less, further more preferably 1.1 or less, further more preferably 1.0.

The average grain size of the prior austenite grains is the average value of the circle equivalent diameters.

With an average grain size of prior austenite grains of less than 0.1 μm, the work hardening characteristic of the steel sheet is lost, so cracking easily occurs when coiling the strip after hot rolling or when uncoiling it at the next step. On the other hand, if greater than 3.0 μm, at the steel sheet made high in strength, the low temperature toughness becomes inferior. The average grain size of the prior austenite grains is preferably 0.5 μm to 2.5 μm, more preferably 0.7 μm to 2.4 μm, still more preferably 1.0 μm to 2.3 μm.

The coefficient of variation is calculated by the "standard deviation"/"average grain size" of the grain size of the prior austenite grains. If high strain is applied during hot rolling and recrystallization occurs, crystal grains right after recrystallization and crystal grains grown after recrystallization become mixed. For this reason, the standard deviation of the grain size of the prior austenite grains becomes larger and the coefficient of variation becomes larger. Due to the fine grain region, propagation of cracks is suppressed, so the finer the grains and the higher the coefficient of variation, the more improved the toughness of the steel sheet. If the coefficient of variation is 0.40 or more, an excellent toughness is obtained. The coefficient of variation is preferably 0.45 or more, more preferably 0.50 or more, still more preferably 0.55 or more. The upper limit of the coefficient of variation is not particularly limited, but for example may be 0.80.

The steel sheet at the position of ¼ the thickness from the surface in the L-cross-section of the steel sheet was polished to a mirror finish, then corroded by 3% Nital (3% nitric acid-ethanol solution). A scan type electron microscope (SEM) can be used to observe the microstructure and measure the aspect ratios, average grain size, and standard deviation of grain size distribution of prior austenite grains. Specifically, a range in which about 10,000 crystal grains can be observed in 1 field can be captured by observation through an SEM and image analysis software (WinROOF) can be used to analyze the image and calculate the average grain size, the average value of the aspect ratios, and the standard deviation of the grain size distribution of the prior austenite grains.

The metal structures at the position of ¼ the thickness from the surface in the L-cross-section of the steel sheet of the present embodiment further contain a texture with an X-ray diffraction intensity ratio of the {001}<110> orientation for a random sample (below, referred to as the "X-ray random intensity ratio") of 2.0 or more.

The larger the X-ray random intensity ratio of the {001}<110> orientation vertical to the rolling surface and parallel to the rolling direction, the smaller the effect of the crystal orientation on the toughness in the rolling direction and the vertical direction of the same, the more reduced the anisotropy in the L-direction and C-direction. The X-ray random intensity ratio of the {001}<110> orientation for a random sample is preferably 3.0 or more, more preferably 4.0 or more.

The X-ray random intensity ratio is the intensity ratio of the X-ray intensity of a hot rolled steel sheet sample being measured to the X-ray intensity of a powder sample having a random distribution of orientations in X-ray diffraction measurement and is measured by using the diffractometer method using a suitable X-ray tube to measure the X-ray diffraction intensity of the α{002}face and comparing it with the diffraction intensity of a random sample.

If measurement by X-ray diffraction is difficult, the EBSD (electron back scattering diffraction pattern) method may be used for measurement in a region where 5,000 or more crystal grains can be measured by pixel measurement intervals of ⅕ or less the average grain size and the X-ray random intensity ratio can be measured from the pole figure or distribution of the ODF (orientation distribution function).

Tensile Strength of 1180 MPa or More

The hot rolled steel sheet according to the present embodiment, envisioning application for improvement of the collision safety of automobiles etc. or lightening the car body weight, is given tensile strength of 1180 MPa or more. The upper limit of the tensile strength is not particularly provided, but is preferably 2000 MPa, at which the toughness was evaluated, or less.

Next, the method for producing the hot rolled steel sheet according to the present embodiment will be explained.

The method for producing the hot rolled steel sheet according to the present embodiment comprises the following steps (a) to (e):

(a) a heating step of heating a slab having the above chemical composition to 1100° C. or more and less than 1350° C.;

(b) a rolling step of rolling the slab after the heating using a rolling machine having a plurality of four or more stands, wherein the total length of last four stands among the plurality of stands is 18 meters or less and the reduction in sheet thickness before and after the last four stands satisfies the following formula 1:

$$1.2 \leq \ln(t_0/t) \leq 3.0 \quad \text{(formula 1)}$$

wherein, $t_0$ is the sheet thickness right before entering the last four stands, and t is the sheet thickness right after leaving the last four stands;

(c) a step wherein a strain rate at a final stand of the last four stands and a rolling temperature at the final stand satisfy the following formula 2 and formula 3:

$$11.0 \leq \log(v \times \exp(33000/(273+T)) \leq 15.0 \quad \text{(formula 2)}$$

$$T \geq Ar_3 \text{ point} \quad \text{(formula 3)}$$

wherein v is a strain rate (/s) at the final stand while T is a rolling exit side temperature (° C.) at the final stand;

(d) a cooling step of starting cooling the rolled steel sheet within 1.0 second after the end of the rolling and cooling the rolled steel sheet over a temperature range of a final rolling temperature to 750° C. by a 100° C./s or more average cooling rate; and (e) a coiling step of coiling the cooled steel sheet after the cooling step.

Below, each step will be explained.

Heating Step

Before the hot rolling, the slab is heated. When heating a slab having the same chemical composition as the hot rolled steel sheet according to the present embodiment obtained by continuous casting etc., if the temperature of the heating is less than 1100° C., the slab becomes insufficiently homogenized. In this case, the obtained steel sheet falls in strength and workability. On the other hand, if the heating temperature becomes 1350° C. or more, the initial austenite grain size becomes larger and it becomes difficult to create structures of the steel sheet so that the average grain size of the prior austenite grains becomes 3.0 μm or less. For this reason, the heating temperature is 1100° C. or more and less than 1350° C.

Rolling Step

In the rolling step, in tandem rolling using a rolling machine having a plurality of four or more stands to continuously roll steel sheet, it is important to control the total distance of the last four stands among the plurality of stands, the cumulative strain (reduction of sheet thickness) in rolling at the four stands, and the rolling temperature and strain rate at the final stand. The rolling machine is a tandem rolling one, so if the strain at the four successive back end rolling stands is in suitable ranges, the strain accumulates. Further, at the final stand, by setting a suitable strain rate and rolling temperature, it is possible to cause recrystallization at the austenite by the accumulated strain. Normally, there are usually six or seven finishing stands of hot rolling. Of course, this number is not limited, but in the present invention, the rolling in the last four stands among the plurality of stands is controlled to set the amount of strain and the strain rate at suitable ranges.

Specifically, a plurality of four or more stands are placed so that the total length of the last four stands is 18 meters or more. The steel sheet is rolled by continuous tandem stands, so if the strain rate at the final stand among the four or more stands is suitable, it is possible to be able to adjust the time between passes of the last four stands (three) to the rolling rate and rolling reduction enabling accumulation of strain. That is, if the rolling rate and rolling reduction of the final stand exit side are determined, the rolling rate at the previous stand is determined. For example, rolling rate of one stand before final one rolling rate of final stand×(1-rolling reduction of final stand). Further, time between passes=distance between passes/rolling rate of one stand before final one. Therefore, it is possible to find the time between passes and strain rate of all stands from the distance between passes and the cumulative true strain (reduction in sheet thickness). With a total length of the last four stands of over 18 meters, the time between passes becomes longer, so it is not possible to accumulate the strain required for recrystallization, the aspect ratio of prior austenite grains become larger, and the Z-ray random intensity ratio becomes smaller. The lower limit value of the total length of the last four stands is preferably 10 meters or more from the viewpoint of facilitating control between passes.

At the last four stands, strain of the following formula 1:

$$1.2 \leq \ln(t_0/t) \leq 3.0 \quad \text{(formula 1)}$$

is imparted, wherein $\ln(t_0/t)$ indicates the true strain accumulating through reduction of sheet thickness (log strain), $t_0$ is the sheet thickness right before entering the last four stands, and t is the sheet thickness right after exiting from the last four stands. If the value of $\ln(t_0/t)$ is less than 1.2, the strain required for recrystallization is not imparted at the final stand and the aspect ratio of the prior austenite becomes larger. If the value of $\ln(t_0/t)$ is over 3.0, the reduction of sheet thickness becomes too large and the time between passes ends up becoming longer, so sufficient strain cannot be imparted at the final stand, recrystallization is no longer possible, and the aspect ratio of the prior austenite becomes greater.

At the final stand of the last four stands, rolling is performed by a strain rate and rolling temperature satisfying the following formula 2 and formula 3:

$$11.0 \leq \log(v \times \exp(33000/(273+T)) \leq 15.0 \quad \text{(formula 2)}$$

$$T \geq Ar_3 \text{ point} \quad \text{(formula 3)}$$

wherein v is the strain rate (/s) at the final stand while T is the rolling exit side temperature (° C.) at the final stand. The formula 2 was calculated based on the relationship of the strain rate and temperature of the Zener-Hollomon parameter (Z parameter):

$$Z = \acute{\varepsilon} \exp(Q/RT)$$

($\acute{\varepsilon}$: strain rate, T: temperature, Q: apparent activation energy, R: gas constant)

With a value of log(v×exp(33000/(273+T)) of less than 11.0, the strain rate is slow or the rolling temperature is high or both, so the average grain size of the obtained prior austenite grains coarsens. With a value of log(v×exp(33000/(273+T)) of over 15.0, the strain rate is fast or the rolling temperature is low or both, so the austenite is not recrystallized, the aspect ratio becomes larger, and the X-ray random intensity ratio becomes smaller. Further, the strain rate also has an effect on the time of growth of the recrystallized grains of austenite. That is, the slower the strain rate, the larger the standard deviation of the recrystallized grain size. On the other hand, if the strain rate is too fast, the time required for recrystallization during the hot finish rolling can no longer be secured, so recrystallization no longer occurs. Note that, if the relationship between the strain rate and rolling temperature satisfies the above formula 2, these values are not restricted. However, to get the aspect ratio of the prior austenite grains in a predetermined range, it is necessary to cause recrystallization at the austenite single phase. If ferrite is formed during rolling, due to the ferrite, recrystallization of austenite is suppressed and the crystal grains become flat, so at the rolling exit side, this has to be performed at the austenite single phase. At the final stand of the last four stands, it is necessary to satisfy formula 2 and satisfy formula 3. T is the rolling exit side temperature at the final stand. In the method of producing the hot rolled steel sheet according to the present embodiment, by T being the $Ar_3$ point or more, tensile strength of 1180 MPa or more can be obtained. The $Ar_3$ point is calculated by the following formula:

$$Ar_3=901-325\times C+33\times Si-92\times Mn+287\times P$$

Cooling Step

After the end of rolling, to finely maintain the recrystallized austenite structures created due to rolling, the cooling is started within 1.0 second. In the temperature range from the finishing rolling temperature to 750° C., the cooling is performed by an average cooling rate of 100° C./s or more. If the cooling start time exceeds 1.0 second, time is taken from when recrystallization occurs to when cooling is started, so due to Ostwald growth, the fine grain region is absorbed by the coarse grains, the prior austenite grains become larger, the coefficient of variation becomes smaller, and the toughness falls. If the cooling rate is less than 100° C./s, growth of austenite occurs even during cooling, the average grain size of prior austenite grains becomes coarser, and the coefficient of variation becomes smaller. With a cooling rate of less than 750° C., the effect on the austenite grain size is small, so the cooling rate for obtaining the target hot rolled structures can be freely selected.

The upper limit of the cooling rate is not particularly limited, but considering restrictions in facilities etc. and, further, for making the distribution of structures in the sheet thickness direction more uniform, 600° C./s or less is preferable. Regarding the cooling stop temperature, to stably maintain the prior austenite grain size by fine grains, cooling down to 550° C. or less is preferable.

Coiling Step

The structures transformed from austenite structures created at the cooling step are not limited. If making the hot rolled steel sheet as hot rolled the finished product, to more stably secure tensile strength of 1180 MPa or more, the steel sheet is preferably coiled at less than 550° C. If performing cold rolling in the next step, to lower the load at the time of cold rolling, the steel sheet is preferably coiled at 550° C. to less than 750° C. and softened.

Other Steps

The hot rolled steel sheet of the present embodiment does not require pickling, cold rolling, and subsequent working, but the fabricated hot rolled steel sheet may be pickled and cold rolled.

For example, to remove the scale on the surface of the hot rolled steel sheet, it is possible to pickle and cold roll the sheet to adjust the thickness of the steel sheet. The conditions of the cold rolling step are not particularly limited, but from the viewpoints of the workability and precision of thickness, the cold rolling rate is preferably 30% to 80%. By making the cold rolling rate 80% or less, it is possible to suppress cracks of the steel sheet edges and excessive rise of strength due to work hardening.

The cold rolled steel sheet may also be annealed. To suppress coarsening of the size of the austenite grains formed in the hot rolling, the highest temperature of the annealing is preferably 900° C. or less. On the other hand, from the viewpoint of the productivity of preventing a long time being taken for creating rolled structures by recrystallization, 500° C. or more is preferable. After annealing, the sheet may be temper rolled for the purpose of correcting the shape or adjusting the surface roughness. In temper rolling, the rolling reduction is preferably 1.0% or less so as not to leave behind rolled structures.

The hot rolled steel sheet may be electroplated or hot dip coated with alloying so as to improve the corrosion resistance of the surface. In the plating step, if applying heat, to suppress coarsening of the size of the austenite grains created in the hot rolling step, 900° C. or less is preferable. After plating, the sheet may be temper rolled for the purpose of correcting the shape or adjusting the surface roughness. In temper rolling, the rolling reduction is preferably 1.0% or less so as not to leave behind rolled structures. If cold rolling the hot rolled steel sheet, the cold rolled steel sheet may also be electroplated, hot dip coated, or hot dip coating with alloying and temper rolled.

EXAMPLES

Below, the hot rolled steel sheet of the present invention will be specifically explained with reference to examples. However, the conditions of the examples are just illustrations of the conditions employed for confirming the workability and effect of the present invention. The present invention is not limited to the following examples. It may be worked with suitable changes made within a range able to match the gist so long as not departing from the gist of the present invention and realizing the object of the present invention. Accordingly, the present invention can employ various conditions. These are all included in the technical features of the present invention.

Steel having the chemical composition shown in Table 1 and having an Ara point was smelted in a converter, then continuously cast to obtain a thickness 230 mm slab. After that, the slab was heated to a 1200° C. to 1250° C. temperature, rough rolled, then heated, finish rolled, cooled, and coiled by the heating temperature, finishing temperature, cooling rate, and coiling temperature shown in Table 2 to produce a hot rolled steel sheet.

Table 2 further shows the constituents of the steel types used, the finish rolling conditions, and the thicknesses of the steel sheets. In Table 2, the "strain rate" is the strain rate at the final stand of the successive finish rolling stands, the "entry thickness" is the entry side thickness right before entering the last four stands in a finish rolling machine in which a plurality of four or more stands successively follow, the "exit thickness" is the exit side thickness right after exiting from the last four stands, the "stand length" is the total length of the last four stands among the plurality of stands, the "starting time" is the time from the end of the finish rolling at the final stand to the start of cooling, the "cooling rate" is the average cooling rate from the finish rolling temperature to 750° C., and the "coiling temperature" is the coiling temperature after the end of cooling.

TABLE 1

Table 1

| Steel | Matrix constituents (mass %) | | | | | | | | | | | | $Ar_3$ |
|---|---|---|---|---|---|---|---|---|---|---|---|---|---|
| type | C | Si | Mn | P | S | Al | N | Ti | Nb | Ca | Mo | Cr | (° C.) |
| A | 0.12 | 1.20 | 1.2 | 0.015 | 0.002 | 0.01 | 0.003 | — | — | — | — | — | 796 |
| B | 0.12 | 1.20 | 1.6 | 0.014 | 0.003 | 0.01 | 0.003 | 0.11 | — | 0.0020 | — | 0.30 | 758 |
| C | 0.15 | 0.30 | 0.6 | 0.014 | 0.003 | 0.03 | 0.002 | — | 0.020 | — | 0.30 | — | 811 |
| D | 0.15 | 2.00 | 1.8 | 0.015 | 0.001 | 0.03 | 0.002 | — | 0.015 | — | — | — | 757 |
| E | 0.20 | 2.00 | 1.3 | 0.015 | 0.001 | 0.30 | 0.004 | 0.02 | — | 0.0030 | — | 0.55 | 787 |
| F | 0.20 | 1.80 | 0.7 | 0.014 | 0.003 | 0.30 | 0.004 | 0.12 | 0.035 | — | — | — | 835 |
| G | 0.40 | 0.30 | 2.0 | 0.013 | 0.006 | 0.10 | 0.002 | — | 0.010 | — | — | 0.10 | 601 |
| H | 0.40 | 1.50 | 2.5 | 0.015 | 0.005 | 0.10 | 0.002 | 0.02 | — | 0.0010 | 0.20 | 0.67 | 595 |
| I | 0.30 | 1.30 | 0.8 | 0.015 | 0.003 | 0.01 | 0.002 | — | — | — | — | — | 777 |
| J | 0.17 | 0.21 | 0.8 | 0.014 | 0.002 | 0.01 | 0.002 | — | — | — | — | — | 785 |

TABLE 2

| No. | Consti. | Heat temp. (° C.) | Finish temp. (° C.) | Strain rate (/ %) | Entry thick. (mm) | Exit thick. (mm) | Formula 1 | Formula 2 | Stand length (m) | Start time (s) | Cool rate (° C./s) | Coil temp. (° C.) | Prior γ grain size (μm) | Coeff. of variation | Aspect ratio | X-ray random intensity ratio | Tensile strength | Trans. temp. | Anisotropy | Remarks |
|---|---|---|---|---|---|---|---|---|---|---|---|---|---|---|---|---|---|---|---|---|
| 1 | A | 1200 | 888 | 200 | 40 | 3.0 | 2.6 | 14.6 | 15.0 | 0.2 | 150 | 283 | 1.3 | 0.47 | 1.8 | 4.0 | 1324 | −87 | 0.68 | Inv.ex. |
| 2 | A | 1200 | 914 | 200 | 20 | 5.0 | 1.4 | 14.4 | 15.0 | 0.1 | 196 | 350 | 1.7 | 0.63 | 1.3 | 6.8 | 1673 | −97 | 0.85 | Inv.ex. |
| 3 | A | 1200 | 1067 | 5 | 40 | 5.0 | 2.1 | 11.4 | 15.0 | 1.0 | 167 | 369 | 1.1 | 0.57 | 1.5 | 5.5 | 1288 | −72 | 0.79 | Inv.ex. |
| 4 | A | 1250 | 904 | 120 | 40 | 3.5 | 2.4 | 14.3 | 15.0 | 1.0 | 138 | 299 | 2.4 | 0.47 | 1.2 | 3.2 | 1435 | −92 | 0.81 | Inv.ex. |
| 5 | A | 1200 | 982 | 12 | 40 | 6.0 | 1.9 | 12.5 | 16.5 | 0.6 | 188 | 198 | 1.0 | 0.49 | 1.1 | 4.3 | 1636 | −72 | 0.80 | Inv.ex. |
| 6 | B | 1200 | 930 | 120 | 20 | 10.0 | 0.7 | 14.0 | 16.5 | 0.3 | 109 | 25 | 1.1 | 0.48 | 2.5 | 4.8 | 1494 | −58 | 0.57 | Comp.ex. |
| 7 | B | 1150 | 896 | 150 | 40 | 6.5 | 1.8 | 14.4 | 14.0 | 0.5 | 188 | 161 | 2.4 | 0.41 | 1.7 | 5.0 | 1699 | −100 | 0.73 | Inv.ex. |
| 8 | B | 1250 | 890 | 150 | 60 | 3.0 | 3.0 | 14.5 | 14.0 | 0.2 | 169 | 616 | 1.6 | 0.52 | 1.9 | 5.9 | 1653 | −74 | 0.66 | Inv.ex. |
| 9 | B | 1200 | 894 | 100 | 60 | 3.0 | 3.0 | 14.3 | 14.0 | 0.7 | 122 | 301 | 1.1 | 0.49 | 1.1 | 3.8 | 1233 | −81 | 0.86 | Inv.ex. |
| 10 | C | 1250 | 1020 | 10 | 60 | 3.6 | 2.8 | 12.1 | 14.0 | 0.3 | 129 | 535 | 2.0 | 0.62 | 1.7 | 5.9 | 1464 | −50 | 0.74 | Inv.ex. |
| 11 | C | 1250 | 970 | 120 | 60 | 3.2 | 2.9 | 13.6 | 12.0 | 0.1 | 165 | 160 | 1.1 | 0.46 | 1.8 | 6.5 | 1337 | −76 | 0.74 | Inv.ex. |
| 12 | C | 1200 | 907 | 120 | 60 | 4.2 | 2.7 | 14.2 | 12.0 | 0.2 | 158 | 324 | 2.4 | 0.54 | 1.7 | 4.8 | 1692 | −77 | 0.74 | Inv.ex. |
| 13 | C | 1200 | 887 | 120 | 20 | 2.0 | 2.3 | 14.4 | 12.0 | 0.7 | 141 | 72 | 2.4 | 0.44 | 1.4 | 6.3 | 1322 | −101 | 0.75 | Inv.ex. |
| 14 | C | 1150 | 1012 | 1 | 20 | 2.0 | 2.3 | 11.2 | 12.0 | 0.7 | 284 | 501 | | | | | | | | |
| 15 | D | 1200 | 902 | 250 | 30 | 1.0 | 3.4 | 14.6 | 12.0 | 0.1 | 202 | 264 | | | | | | | | |
| 16 | D | 1250 | 939 | 250 | 15 | 1.2 | 2.5 | 14.2 | 16.5 | 0.6 | 158 | 247 | | | | | | | | |
| 17 | D | 1200 | 800 | 50 | 20 | 1.2 | 2.8 | 15.1 | 16.5 | 0.1 | 195 | 379 | | | | | | | | |
| 18 | D | 1200 | 881 | 40 | 5 | 0.8 | 1.8 | 14.0 | 10.0 | 0.3 | 167 | 513 | | | | | | | | |
| 19 | E | 1150 | 904 | 60 | 100 | 10.0 | 2.3 | 14.0 | 10.0 | 0.6 | 344 | 606 | | | | | | | | |
| 20 | E | 1250 | 927 | 20 | 100 | 16.0 | 1.8 | 13.2 | 10.0 | 0.1 | 153 | 271 | | | | | | | | |
| 21 | E | 1200 | 884 | 250 | 100 | 8.0 | 2.5 | 14.8 | 10.0 | 0.2 | 135 | 495 | | | | | | | | |
| 22 | E | 1200 | 1050 | 250 | 100 | 12.0 | 2.1 | 13.2 | 10.0 | 0.9 | 194 | 348 | | | | | | | | |
| 23 | F | 1250 | 889 | 120 | 150 | 16.0 | 2.2 | 14.4 | 10.0 | 0.6 | 215 | 459 | | | | | | | | |
| 24 | F | 1150 | 1120 | 1 | 150 | 20.0 | 2.0 | 10.3 | 10.0 | 0.9 | 106 | 676 | | | | | | | | |
| 25 | F | 1250 | 900 | 120 | 150 | 20.0 | 2.0 | 14.3 | 11.0 | 0.8 | 126 | 259 | | | | | | | | |
| 26 | F | 1200 | 924 | 280 | 150 | 16.0 | 2.2 | 14.4 | 15.0 | 0.6 | 192 | 116 | | | | | | | | |
| 27 | G | 1250 | 892 | 300 | 100 | 22.0 | 1.5 | 14.8 | 15.0 | 0.3 | 100 | 100 | | | | | | | | |
| 28 | G | 1250 | 912 | 280 | 60 | 6.0 | 2.3 | 14.5 | 15.0 | 2.3 | 135 | 245 | | | | | | | | |
| 29 | G | 1200 | 1080 | 10 | 60 | 3.0 | 3.0 | 11.6 | 15.0 | 0.3 | 134 | 124 | | | | | | | | |
| 30 | G | 1200 | 889 | 320 | 30 | 2.0 | 2.7 | 14.8 | 15.0 | 0.5 | 172 | 611 | | | | | | | | |
| 31 | G | 1250 | 912 | 320 | 9 | 1.0 | 2.2 | 14.6 | 16.5 | 0.2 | 185 | 573 | | | | | | | | |
| 32 | H | 1200 | 902 | 15 | 3 | 0.8 | 1.3 | 13.4 | 20.0 | 0.2 | 124 | 262 | | | | | | | | |
| 33 | I | 1250 | 885 | 15 | 30 | 1.5 | 3.0 | 13.6 | 16.5 | 0.4 | 188 | 309 | | | | | | | | |
| 34 | J | 1200 | 679 | 20 | 32 | 12 | 1.0 | 16.4 | 16.5 | 0.3 | 102 | 550 | | | | | | | | |
| 35 | J | 1230 | 910 | 130 | 9 | 3 | 1.1 | 14.2 | 20.0 | 0.3 | 400 | 640 | | | | | | | | |

TABLE 2-continued

| | | | | | | | |
|---|---|---|---|---|---|---|---|
| 0.7 | 0.49 | 1.1 | 4.1 | 1411 | −70 | 0.94 | Inv.ex. |
| 1.2 | 0.58 | 3.5 | 5.2 | 1363 | −55 | 0.42 | Comp.ex. |
| 1.6 | 0.65 | 1.7 | 3.5 | 1441 | −100 | 0.68 | Inv.ex. |
| 1.2 | 0.58 | 2.2 | 1.8 | 1626 | −91 | 0.48 | Comp.ex. |
| 1.1 | 0.47 | 1.1 | 3.8 | 1198 | −86 | 0.92 | Inv.ex. |
| 1.2 | 0.52 | 1.1 | 5.3 | 1234 | −99 | 0.82 | Inv.ex. |
| 1.1 | 0.47 | 1.8 | 3.8 | 1628 | −72 | 0.71 | Inv.ex. |
| 2.1 | 0.45 | 1.2 | 6.0 | 1369 | −83 | 0.82 | Inv.ex. |
| 2.2 | 0.51 | 1.1 | 5.6 | 1626 | −110 | 0.92 | Inv.ex. |
| 2.4 | 0.61 | 1.8 | 6.9 | 1231 | −69 | 0.75 | Inv.ex. |
| 5.2 | 0.56 | 1.3 | 6.4 | 1401 | −42 | 0.76 | Comp.ex. |
| 1.2 | 0.49 | 2.0 | 5.7 | 1381 | −82 | 0.65 | Inv.ex. |
| 1.7 | 0.68 | 1.3 | 3.6 | 1505 | −98 | 0.87 | Inv.ex. |
| 2.5 | 0.52 | 1.4 | 3.4 | 1268 | −71 | 0.76 | Inv.ex. |
| 8.2 | 0.18 | 1.1 | 3.8 | 1211 | −25 | 0.92 | Comp.ex. |
| 0.7 | 0.52 | 1.3 | 6.6 | 1356 | −72 | 0.76 | Inv.ex. |
| 1.3 | 0.60 | 1.3 | 4.7 | 1487 | −78 | 0.84 | Inv.ex. |
| 1.2 | 0.52 | 1.7 | 4.0 | 1359 | −87 | 0.72 | Inv.ex. |
| 2.2 | 0.45 | 2.9 | 1.5 | 1190 | −101 | 0.52 | Comp.ex. |
| 1.9 | 0.57 | 1.6 | 6.4 | 1314 | −61 | 0.77 | Inv.ex. |
| 4.2 | 0.61 | 2.5 | 1.7 | 530 | −53 | 0.38 | Comp.ex. |
| 5.2 | 0.72 | 3.2 | 1.3 | 1182 | −62 | 0.42 | Comp.ex. |

The thus obtained steel sheet was polished to a mirror finish at the position of ¼ the thickness from the surface in the L-cross-section of the steel sheet, then was corroded by 3% Nital (3% nitric acid-ethanol solution). A range in which about 10,000 crystal grains can be observed in 1 field was captured by observation through an SEM and image analysis software (WinROOF) was used to analyze the image and calculate the average grain size, the standard deviation of the grain size distribution, and the average value of the aspect ratios of the prior austenite grains. The standard deviation of the distribution of grain size was divided by the average grain size to calculate the coefficient of variation.

At the center part at the position of ¼ the thickness from the surface in the L-cross-section of the steel sheet of the present embodiment, the EBSD (electron back scattering diffraction pattern) method was used to measure the X-ray random intensity ratio of the {001}<110> orientation from the pole figure or distribution of the ODF (orientation distribution function) in a region where 5000 or more crystal grains can be measured by pixel measurement intervals of ⅕ or less the average grain size.

For the tensile test of steel sheet, a JIS No. 5 test piece was taken in the rolling width direction (C-direction) of the steel sheet and the tensile strength TS (MPa) was evaluated based on JIS Z 2241.

As evaluation of the toughness of the steel sheet, the ductile-brittle transition temperature was measured. The ductile-brittle transition temperature was measured by using a 2.5 mm subsize V-notch test piece prescribed in JIS Z 2242 to perform a C-direction notch Charpy impact test and making the temperature where the brittle fracture rate becomes 50% the ductile-brittle transition temperature. Further, samples where the final thickness of the steel sheet was less than 2.5 mm were measured over the entire thickness. Samples where the ductile-brittle transition temperature is −50° C. or less were evaluated as "passing". For the anisotropy, the absorption energies of the C-direction notch and L-direction notch were measured at −60° C., the ratio (L-direction/C-direction) was calculated, and, if 0.6 to 1.0, the anisotropy was excellent.

Table 2 shows the results of measurement of the prior austenite grain size (priory grain size), coefficient of variation of prior austenite grains, aspect ratio of prior austenite grains, X-ray random intensity ratio in the {001}<110>orientation, tensile strength, ductile-brittle transition temperature, and anisotropy. As shown in Table 2, in the invention examples, the tensile strength was 1180 MPa or more, the transition temperature was −50° C. or less, and the strength and toughness were excellent.

As opposed to this, in Test No. 6, the value of formula 1 became less than 1.2 and the cumulative strain at the last four stands was insufficient, so the austenite could not recrystallize and the aspect ratio exceeded 2.0. For this reason, the anisotropy was less than 0.6.

In Test No. 15, the value of formula 1 exceeded 3.0, the reduction in thickness at the last four stands was too large, and the time between passes became longer, so the strain required for recrystallization could not be imparted, the aspect ratio was a high one of over 2.0, and the anisotropy was less than 0.6.

In Test No. 17, the rolling finishing temperature was a bit low, the value of formula 2 was over 15.0, and austenite could not recrystallize, so the aspect ratio was high, the X-ray random intensity ratio was small (low integration of a texture), and the anisotropy was less than 0.6.

In Test No. 24, the rolling finishing temperature was high and the strain rate was slow, so the value of formula 2 became less than 11.0 and the average grain size of the austenite grains became coarser, so the transition temperature exceeded −50° C. and the toughness deteriorated.

In Test No. 28, the cooling start time was a long one of more than 1.0 second and time passed from when recrystallization was manifested to the start of cooling, so due to Ostwald growth, the fine grain region was absorbed by the coarse grains, the prior austenite grains became larger, and dynamic coefficient was small, so the toughness deteriorated.

In Test No. 32, the stand length of the last four stands was over 18 meters, the time between passes was long, and the strain required for recrystallization could not be accumulated, so the aspect ratio was large and the X-ray random intensity ratio was small (low integration of a texture) and the anisotropy was less than 0.6.

In Test No. 34, the finishing temperature was below the Ara point described in Table 1, so the tensile strength became lower. Furthermore, the cumulative strain at the last four stands was a small one of a value of formula 1 of less than 1.2, furthermore, the rolling finishing temperature was a low one of a value of formula 2 of over 15.0, the aspect ratio was large and the X-ray random intensity ratio was small (low integration of a texture), and the anisotropy was less than 0.6.

In Test No. 35, the cumulative strain at the last four stands was a small one of a value of formula 1 of less than 1.2, furthermore, the stand length at the last four stands was over 18 meters, the aspect ratio was large, and the X-ray random intensity ratio was small (low integration of a texture). For this reason, the anisotropy was less than 0.6.

The invention claimed is:

1. A hot rolled steel sheet characterized by consisting of, by mass %,

C: 0.10% or more and 0.50% or less,
Si: 0.10% or more and 3.00% or less,
Mn: 0.5% or more and 3.0% or less,
P: 0.100% or less,
S: 0.010% or less,
Al: 1.00% or less,
N: 0.010% or less,
optionally one or more elements selected from the group consisting of
Ti: 0.02% or more and 0.20% or less,
Nb: 0.00% or more and 0.10% or less,
Ca: 0.0000% or more and 0.0060% or less,
Mo: 0.00% or more and 0.50% or less, and
Cr: 0.0% or more and 1.0% or less,
and
a balance of Fe and impurities,
wherein a metal structure at a position of ¼ thickness from a surface in an L-cross-section of the steel sheet comprises prior austenite grains of an average value of aspect ratios of 2.0 or less, an average grain size of 0.1 μm or more and 3.0 μm or less, and a coefficient of variation of a standard deviation of grain size distribution/average grain size of 0.40 or more, and a texture with an X-ray diffraction intensity ratio of {001}<110>orientation with respect to random samples of 2.0 or more, and
the hot rolled steel sheet has tensile strength of 1180 MPa or more.

2. A method for producing the hot rolled steel sheet according to claim 1, characterized in that the method comprises steps (a) to (e) shown below:

(a) a heating step of heating a slab having a chemical composition according to claim 1 to 1100° C. or more and less than 1350° C.;
(b) a rolling step of rolling the slab after the heating using a rolling machine having a plurality of four or more stands, wherein total length of last four stands among the plurality of stands is 18 meters or less and reduction in sheet thickness before and after the last four stands satisfies a following formula 1:

$$0.2 \leq \ln(t_0/t) \leq 3.0 \quad \text{(formula 1)}$$

wherein $t_0$ is a sheet thickness right before entering the last four stands, and t is a sheet thickness right after leaving the last four stands;
(c) a step wherein a strain rate at a final stand of the last four stands and a rolling temperature at the final stand satisfy following formula 2 and formula 3:

$$11.0 \leq \log(v \times \exp(33000/(273+T)) \leq 15.0 \quad \text{(formula 2)}$$

$$T \geq Ar_3 \text{ point} \quad \text{(formula 3)}$$

wherein v is a strain rate (/s) at the final stand while T is a rolling exit side temperature (° C.) at the final stand;
(d) a cooling step of starting cooling the rolled steel sheet within 1.0 second after an end of the rolling and cooling the rolled steel sheet over a temperature range of a final rolling temperature to 750° C. by a 100° C./s or more average cooling rate; and
(e) a coiling step of coiling the cooled steel sheet after the cooling step.

* * * * *